US005345871A

United States Patent [19]

Stang

[11] Patent Number: 5,345,871

[45] Date of Patent: Sep. 13, 1994

[54] IGNITER-DESTRUCTOR DEVICE

[75] Inventor: Guido Stang, Buggingen, Fed. Rep. of Germany

[73] Assignee: Buck Werke GmbH & Co., Bad Uberkingen, Fed. Rep. of Germany

[21] Appl. No.: 88,609

[22] Filed: Jul. 7, 1993

Related U.S. Application Data

[63] Continuation of Ser. No. 508,192, Apr. 11, 1990, abandoned.

[30] Foreign Application Priority Data

Apr. 13, 1989 [DE] Fed. Rep. of Germany ..... 3912183

[51] Int. Cl.[5] ..... F42C 19/08

[52] U.S. Cl. ..... 102/202; 102/470

[58] Field of Search ..... 102/202, 204, 205, 470, 102/472

[56] References Cited

U.S. PATENT DOCUMENTS

| | | | |
|---|---|---|---|
| 2,960,935 | 11/1960 | Colpitts | 102/202 |
| 2,995,088 | 8/1961 | Asplund | 102/202 |
| 3,003,419 | 10/1961 | Fite, Jr. | 102/202 |
| 3,182,595 | 5/1965 | Hassmann | 102/202 |
| 3,788,227 | 1/1974 | Clifton et al. | 102/204 |
| 4,090,342 | 5/1978 | Rishel | 53/23 |
| 4,336,084 | 6/1982 | Urs | 149/24 |
| 4,358,998 | 11/1982 | Schneiter et al. | 102/202 |
| 4,429,632 | 2/1984 | Yunan | 102/204 |
| 4,624,186 | 11/1986 | Widera et al. | 102/336 |
| 4,669,383 | 6/1987 | Penner | 102/202 |
| 4,690,063 | 9/1987 | Granier et al. | 102/530 |
| 4,807,534 | 2/1989 | Vockensperger et al. | 102/202 |
| 4,817,530 | 4/1989 | Florin | 102/204 |
| 4,860,657 | 8/1989 | Steinicke et al. | 102/334 |

FOREIGN PATENT DOCUMENTS

| | | |
|---|---|---|
| 2811016 | 7/1986 | Fed. Rep. of Germany . |
| 3515166 | 10/1986 | Fed. Rep. of Germany . |
| 3912183 | 10/1990 | Fed. Rep. of Germany . |

*Primary Examiner*—Stephen M. Johnson
*Attorney, Agent, or Firm*—Darby & Darby

[57] ABSTRACT

The present invention describes an igniter-destructor device for projectiles, grenades, cartridges, missiles or the like, comprising a thin-walled aluminum capsule, an igniter-destructor charge provided within said capsule, possibly an ignition expediting material within this charge, and a flange piece disposed at the head-end of the aluminum capsule and having an axial bore. The aluminum capsule is coated with a thin-walled plastic jacket which is preferably made from a shrink hose. Furthermore, there is preferably provided a specifically embodied ignition-expediting material which consists of ignition particles statistically distributed within the igniter-destructor charge. Such an igniter-destructor device is characterized by an especially clean and reliable operation as its functional conception, even under high stress occurring in the use of appliances which such igniter-destructor devices are installed into, remains substantionally unchanged.

32 Claims, 1 Drawing Sheet

IGNITER-DESTRUCTOR DEVICE

This is a continuation of application Ser. No. 07/508,192, filed Apr. 11, 1990, now abandoned.

BACKGROUND OF THE INVENTION

Field of the Invention

The present invention relates to an igniter-destructor device for projectiles, grenades, cartridges, missiles or the like, comprising a thin-walled aluminum capsule, an igniter-destructor charge provided within said capsule, possibly an ignition expediting material within this charge, and a flange piece disposed at the head-end of the aluminum capsule and having an axial bore.

Discussion of Related Art

Generally, such ignition-destructor devices are axially disposed within projectiles, grenades, cartridges, missiles or the like and normally penetrate the same more or less all over that portion of such devices which contains the effective charges so that in general the ignition-destructor device is completely embedded in the effective charge. The effective charge is normally an ignitable and inflammable charge, such as an ignitable and inflammable missile of the known type. A more or less complete through-reaction of the ignition-destructor charge contained in the ignition-destructor device is initiated through an ignition-retarder which is disposed in the axial bore of the flange piece. Upon bursting of the aluminum capsule a spontaneous and extensive ignition of the effective charge and the successive destruction of the container carrying the charge occur. In the known missiles, the effective charge may e.g. consist of common charges on the basis of red phosphorus or of inflammable thin flakes which are ignited through the ignition-destructor charge of the igniter-destructor device and are upon destruction of the container walls distributed in the environment in the desired manner.

German Patent 35 15 166 discloses a missile for producing an areal infrared radiation emitter, the inflammable thin flakes of which form the burning charge when ignited with a combustible layer consisting of an incendiary paste by means of an igniter-destructor device of the afore-mentioned type and which are distributed upon destruction of the casing containing the burning charge to form the desired areal infrared radiation emitter. This igniter-destructor device consists also of a thin-walled aluminum capsule with a flange piece being disposed at the head-end thereof and having an axial bore for receiving the ignition retarder, the igniter-destructor charge within said capsule being axially penetrated by an ignition core forming the ignition-expediting means. A corresponding missile is also known from German Patent 28 11 016, however, the igniter-destructor device of this German patent does not comprise an ignition core.

The known igniter-destructor devices, and especially those devices comprising an ignition core as ignition-expediting means, principally achieve their aim. They involve however the disadvantage of poor mechanical stability. When firing at high launching acceleration rates, as in the case of projectiles and grenades with acceleration values of 15,000 to 20,000 g or more, there is caused a significant deformation and a premature bursting of the thin-walled aluminum capsule. The entails various undesired and troublesome consequences.

The possible bursting of the aluminum capsule by deformation may cause a trickling out of the igniter-destructor charge. If the effective charge (payload) surrounding the igniter-destructor device reacts to friction and/or impact, e.g., where the payload contains red phosphorus, friction along the aluminum capsule may cause a premature ignition of the effective charge and also of the igniter-destructor charge which trickled out. The consequence will be a premature through-ignition of the igniter-destructor charge and thus also a destruction of the payload and of the container containing the payload. All this may also be initiated by impact of the ignition-expediting means, particularly the ignition core, thus causing in turn an undesired premature or in any case irregular destruction. Strong deformation or even bursting of the aluminum capsule weakens the in general also the disadvantage of a weakening of this capsule at certain points. As a consequence, the aluminum capsule is not optimally destroyed simultaneously along its entire circumference upon through-reaction of the igniter-destructor charge.

Although the problem of too little mechanical stability of the aluminum capsule of the igniter-destructor device could, in principal be solved by providing the aluminum capsule with thicker walls, such added strengthening of the aluminum capsule would not be an operable solution of the problem, because the desired ignition, destruction and distribution of the payload require an igniter-destructor device of relatively low mechanical stability. Too high stability of the aluminum capsule containing the igniter-destructor charge will dissipate the payload into too small particles or other damage to the payload would result.

SUMMARY OF THE INVENTION

It is the object of the present invention to provide an igniter-destructor device which is fully operable even at great firing stress, such as in case of accelerations of 15,000 to 20,000 g and more, so that it corresponds in its function to an igniter-destructor device having a substantially intact aluminum capsule.

In an igniter-destructor device of the type described hereinbefore, the aluminum capsule is coated with a thin-walled plastic jacket.

The plastic jacket around the aluminum capsule is preferably made from a shrink hose; it is of advantage if this shrink hose has an inner adhesive coating. Suitably, such a shrink hose has a shrinking temperature of 100° to 200° C., preferably 125° to 175° C. It can therefore easily be slipped in the required length on the aluminum capsule of the ready-made igniter-destructor device and then be adjusted through heating to the respective shrinking temperature, e.g. to 125° C., the inner adhesive coating preferably applied to the shrink hose improving the contact between the aluminum capsule and the plastic jacket applied thereon by shrinkage of the shrink hose.

Those skilled in the art are familiar with shrink hoses; these products are based upon various cold worked thermoplastic synthetics which upon heat treatment return to their original strain-free state. This is the result of a so-called retrogressive capacity or an elastic molding memory of the plastic molecules which such shrink hoses are made from. In addition to the various plastics used as basic material, such shrink hoses may just like other plastic compositions which are also possible in the production of a thin-walled plastic jacket around the aluminum capsule of the present igniter-destructor device possibly contain usual additives such as fillers, extenders and especially various types Of reinforcing agents or pigments.

Shrink hoses suited for use also in the present invention are being employed in the electrical engineering field for the insulation and protection of cable beams. Shrink hoses on the basis of polyethylene are available from T & B, Thomas & Betts GmbH, D-6073 Egelsbach under the various designations PLG (Shrink-Kon).

The thin-walled plastic jacket of the aluminum capsule is an essential feature of the present igniter-destructor device; this plastic jacket may preferably either be made from a shrink hose or may possibly, with greater expenditure, be formed by liquid preparations of the respective plastics applied by immersing, brushing, spraying or rolling followed by a curing treatment. Of course, the liquid plastic preparations employed may possibly again contain fillers, extenders and reinforcing agents or other adjuvants including crosslinkers and polymerization catalysts. The preparation of thin-walled plastic jackets on the basis of liquid plastic compositions for the aluminum capsules is therefore within the frame of the general know-how of those skilled in the art.

The thin-walled plastic jacket applied onto the aluminum capsule of the igniter-destructor device of the present invention, be it made from a shrink hose or a liquid plastic preparation, is preferably based on a synthetic thermoplastic. Polyolefins or copolymers thereof are preferred substances. Examples of suitable plastics are polyethylene which is especially preferred, polypropylene, polyisobutylene, polybutene or copolymers thereof or also polyethyleneterephthalate or polyvinylchloride. Of course, any other plastics such as silicones may be used instead in order to give the aluminum capsule such a finish that the functional characteristics of the igniter-destructor device of the present invention remain almost unchanged on destruction notwithstanding the thin-walled plastic jacket. The disintegration temperature of such a plastic jacket must of course be far below the temperature present at the functioning of the igniter-destructor charge and the destruction of the aluminum capsule; this means that the thermal and mechanical action upon the payload via the igniter-destructor device must substantially not be affected by the thin-walled plastic jacket. However, when the respective missile is fired, the plastic jacket serves to improve the stability of the aluminum capsule such that this capsule does preferably not burst at all or that possible weak points or cracks do not allow the igniter-destructor charge to trickle into the surrounding payload. The plastic coating around the aluminum capsule serves therefore to prevent a contact between the igniter-destructor charge within said igniter-destructor device and the surrounding payload in case the aluminum capsule is damaged. The plastic jacket which is substantially softer than the aluminum of the aluminum capsule serves furthermore to reduce the risk of explosion of the payload through friction or impact occurring in case of relatively great firing stress and then resulting in a premature ignition and through-reaction. In addition, the plastic jacket serves to protect the aluminum capsule against corrosion caused by components of the payload.

The thin-walled plastic jacket applied onto the aluminum capsule of the igniter-destructor device of this invention has suitably a tensile strength of 700 to 1,300 $N/cm^2$, preferably 1,000 to 1,100 $N/cm^2$, and has suitably a breaking tension of 200 to 400% preferably 250 to 350%. In general, the wall thickness is 0.2 to 1.5 m/n, preferably 0.3 to 0.8 mm. The plastic jacket should not melt, should have good resistance against the chemicals of the payload, and should have a temperature stability of generally −40° C. to +120° C., preferably −30° C. to +70° C.

The wall thickness of the aluminum capsule of the igniter-destructor device of this invention depends, of course, upon the respective device; in general, it is around 0.1 and 1.5 mm, preferably 0.2 to 0.8 mm. Such aluminum capsules are generally made by extrusion molding.

The igniter-destructor charge within the aluminum capsule is based upon any usual powder composition and is preferably a powder composition consisting of magnesium and barium nitrate in a weight ratio of approximately 30:70, this powder composition suitably containing in addition approximately 1% of aluminum oxide. Consequently, there is involved a relatively insensitive powder composition.

As already mentioned, the essential feature of the igniter-destructor device of this invention is the thin-walled plastic coating of the aluminum capsule. In addition, it is of importance for the specific function of this igniter-destructor device that the igniter-destructor charge undergoes a reliable through-reaction within the time required for the destruction. It is therefore an advantage if the igniter-destructor charge of the igniter-destructor device of this invention includes an ingnition-expediting agent improving the reaction pattern of the ignition-destructor charge in the desired manner. The ignition-expediting agent must naturally be substantially more sensitive than the igniter-destructor charge, because the ignition-expediting agent is to bring about a possibly fast ignition and through-reaction of the igniter-destructor charge. Nitrocellulose powder is a preferred ignition-expediting agent.

It has been shown that the igniter-destructor device of this invention involves a substantially optimal effective range particularly not only if the aluminum capsule is coated with a thin-walled plastic jacket but if the igniter-destructor charge includes also an ignition-expediting agent which may be realized in the form of various embodiments. A specific embodiment is realized by the present invention by the feature that ignition particles on the basis of the respective ignition composition, preferably on the basis of nitrocellulose powder, are statistically distributed within the igniter-destructor charge. These ignition particles are preferably of granulated or cut extruded material on the basis of the respective ignition composition and have a grain size of approximately 0.5 to 2.5 mm, preferably about 1 to 2 mm. Such ignition particles statistically distributed within the igniter-destructor charge effectuate a fast and reliable through-reaction of the igniter-destructor charge and involve, especially if compared to an also possible ignition core being prepared on the basis of the respective ignition composition and axially penetrating the igniter-destructor charge, the additional advantage that the embedding of the easily inflammable particles into the igniter-destructor composition renders the igniter-destructor composition less sensitive to impact as compared to a composition including a continuous ignition core. Thus, the anyway relatively minor risk of explosion caused by the firing shock is further reduced. The combined use of a plastic jacket and of ignition particles statistically distributed within the igniter-destructor charge represents consequently an especially preferred embodiment of the igniter-destructor device of this invention.

As already mentioned, the ignition-expediting agent may also consist of an ignition core axially penetrating the igniter-destructor charge; such an ignition core is also provided in the igniter-destructor device of the missile described in German Patent 35 15 166.

The quantity of ignition-expediting agent amounts usually to 2 to 7 wt.-% and preferably to 3 to 5 wt.-% related to the weight of the igniter-destructor charge.

The advantages attained by the present invention are particularly to be seen in the feature that owing to the thin-walled plastic jacket around the aluminum capsule the stability and the capacitance of the aluminum capsule of the present igniter-destructor device can be improved in the right proportion without significantly strengthening the capsule. A stronger capsule would result in an uncontrolled and too violent a destruction of the capsule and thus of the missile provided with such an igniter-destructor device. The principally possible mere increase of the wall thickness of the aluminum capsule would therefore not bring about the desired result. When exerting strain on the igniter-destructor device and thus on the aluminum capsule, e.g. through impact or shock, no sharp wrinkles or bends of the aluminum capsule develop; therefore, blind shots have shown only round and soft deformations. Possible damages to the aluminum capsule are covered by the plastic jacket. Even if the capsule were damaged, no igniter-destructor charge would trickle out. The risk of an explosion of the payload caused by friction upon the aluminum capsule on firing is considerably reduced by means of the plastic jacket. Moreover, the plastic jacket has an anti-corrosive effect with respect to the effective substance, which is of advantage especially in case of chemically aggressive charges of effective substances. Consequently, corrosion of the aluminum capsule caused by the components of the surrounding charge of effective substance is substantially excluded. The aforementioned specific advantages resulting from the thin-walled plastic jacket around the aluminum capsule are additionally increased by the disposition of statistically distributed ignition particles within the igniter-destructor charge of this invention, as thus the sensitivity of the igniter-destructor charge to impact is additionally reduced beyond the also possible provision of an ignition core as ignition expediting agent axially passing through the igniter-destructor charge.

Principally, all kinds of projectiles, grenades, cartridges, missiles or the like may make use of the present invention. The igniter-destructor device may therefore also be based only upon a glow charge, an ignition charge or a destructor charge, appliances such as mortar grenades of 60 mm, mortar grenades of 81 mm, mortar cartridges of 120 mm, projectiles of 105 mm, projectiles of 155 mm or also small appliances such as hand fire cartridges and especially missiles using this igniter-destructor device coming into consideration. The employment of the device of this invention is therefore left to the discretion of those skilled in the art.

BRIEF DESCRIPTION OF THE DRAWINGS

Two preferred example embodiments of the present invention are shown and described in detail in the accompanying drawing wherein.

DESCRIPTION OF THE PREFERRED EMBODIMENT

Figure 1:
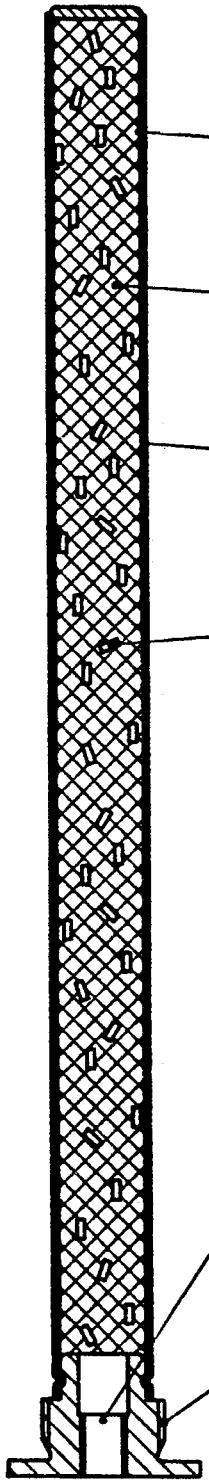
FIG. 1 is a longitudinal sectional view of an igniter-destructor device of this invention containing ignition particles statistically distributed within the igniter-destructor charge.

FIG. 1 shows an igniter-destructor device 1 (for a projectile) consisting of a thin-walled aluminum capsule 3 made by extrusion molding and having a wall thickness of approximately 0.35 mm, a bottom thickness of approximately 1.5 mm, an outer diameter of approximately 12 mm and a length of approximately 180 mm, and of an aluminum flange piece 7 being disposed at the head-end of the aluminum capsule 3 and having at its neck portion an annular groove 15 for connecting the flange piece to the aluminum capsule via a crank.

The flange piece 7 has a threaded axial bore 17 for an ignition retarder (not shown to be screwed into. An outer thread 19 provided at the neck portion of the flange piece 7 serves for fixation in the bottom portion of a projectile not shown.)

The aluminum capsule 3 of the igniter-destructor device 1 is coated with a thin-walled plastic jacket 9 having a wall thickness of approximately 0.35 mm and being made of a shrink hose with an inner adhesive coating. The shrink hose is a plastic hose on the basis of polyethylene which has been obtained by extrusion, which has been crosslinked and modified through radiation, which has a shrinking temperature starting at approximately 125° C., and which has a minimum tensile strength of approximately 1,000 N/cm$^2$ and a minimum breaking tension of 250%. This shrink hose can be used at temperatures ranging between −55° C. and +115° C. and does not melt. It has a maximum specific gravity of 1.25, a radial shrinking capacity of approximately 50% when exposed to heat (125° C. to 200° C.), and a maximum longitudinal shrinking capacity of 10%. Shrink hoses of this type are e.g. available from T & B, Thomas & Betts GmbH, D-6073 Egelsbach under the model designations PLG (Shrink-Kon); in the present invention, a shrink hose model PLG 500-X-Y was used.

The interior of the aluminum capsule 3 is filled with an igniter-destructor charge 5 which is a common relatively insensitive powder charge on the basis of magnesium and barium nitrate in a mixing proportion of 30:70 to which approximately I wt.-% of aluminum oxide has been added. Igniter particles 11 forming the ignition-expediting material on the basis of nitro-cellulose powder are statistically distributed within said igniter-destructor charge 5, these particles being a cut extrudate. These igniter particles 11 may of course be prepared in any other manner and may e.g. also be a more or less coarse granulated material. The weight of the igniter-destructor charge amounts to approximately 18 g, the amount of igniter particles is approximately 0.6 g thus equalling approximately 3.3 wt.-% of the igniter-destructor charge 5.

Figure 2:
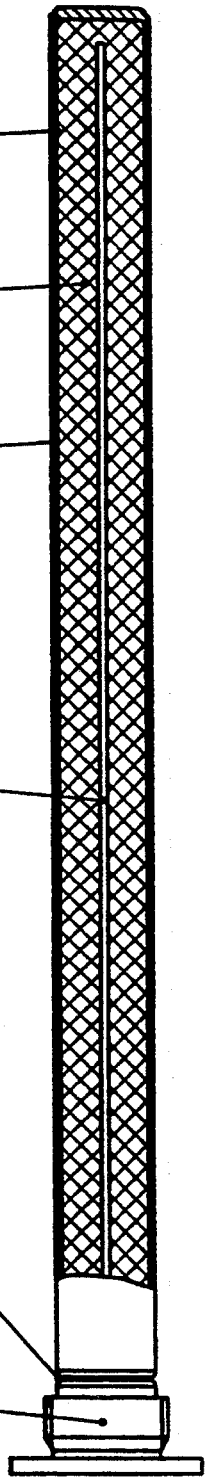
FIG. 2 is a partial longitudinal section of an igniter-destructor device (FIG. 1) of this invention comprising an ignition core axially passing through the igniter-destructor charge.

FIG. 2 shows an igniter-destructor device 1 (for a missile) differing from that one of FIG. 1 only by the feature that it includes instead of the igniter particles 11 an ignition core 13 on the basis of nitrocellulose powder axially passing through the igniter-destructor charge 5. This ignition core consists of an extrudate of ignition-expediting material which, contrary to the igniter particles 11 of FIG. 1, is not cut. However, the ignition core 13 may of course be prepared in any other suitable manner.

What is claimed is:

1. An igniter-destructor device comprising:

an elongated capsule having an aluminum sidewall;

an igniter destructor charge positioned within said capsule;

an ignition-expediting material which forms an ignition core axially penetrating said charge;

a flange element coupled to one end of said capsule, said flange element having an axial bore; and means for protecting the capsule from bursting during firing of the igniter destructor charge so as to prevent any of the igniter destructor charge from making contact with any payload that is surrounding the capsule during firing of the igniter destructor charge, said protecting means including a plastic jacket which covers and longitudinally surrounds the full length of said aluminum sidewall and which prevents the capsule from bursting during firing of the igniter destructor charge.

2. The igniter-destructor device according to claim 1, wherein said plastic jacket is a shrink hose.

3. The igniter-destructor device according to claim 2, wherein said shrink hose has an inner adhesive coating.

4. The igniter-destructor device according to claim 3, wherein said shrink hose has a shrinking temperature of 100° to 200° C.

5. The igniter-destructor device according to claim 4, wherein said shrink hose has a shrinking temperature of 125° to 175° C.

6. The igniter-destructor device according to claim 1, wherein said plastic jacket is a thermoplastic material.

7. The igniter-destructor device according to claim 1, wherein said plastic jacket is composed of a material selected from the group consisting of a polyolefin, polyethylene, polypropylene, polyisobutylene, polybutene, polyethyleneterephthalate, polyvinylchloride and a copolymer of any one of polyethylene, polypropylene, polyisobutylene, and polybutene.

8. The igniter-destructor device according to claim 1, wherein said plastic jacket has a tensile strength of 700 to 1,300 N/Cm$^2$.

9. The igniter-destructor device according to claim 1, wherein said plastic jacket has a wall thickness of 0.2 to 1.5 mm.

10. The igniter-destructor device according to claim 1, wherein said plastic jacket has a wall thickness of 0.3 to 0.8 mm.

11. The igniter-destructor device according to claim 1, wherein said aluminum sidewall has a wall thickness of 0.1 to 1.5 mm.

12. The igniter-destructor device according to claim 1, wherein said aluminum sidewall has a wall thickness of 0.2 to 0.8 mm.

13. The igniter-destructor device according to claim 1, wherein said ignition-destructor charge is a powder charge formed of magnesium nitrate and barium nitrate.

14. The igniter-destructor device according to claim 1, wherein said ignition-expediting material is an agent formed of nitrocellulose powder.

15. The igniter-destructor device according to claim 1, wherein said ignition-expediting material has a 2 to 7 wt. % relative to a weight percentage of said igniter-destructor charge.

16. An igniter device for detonating a payload comprising:

an elongated capsule having a non-perforated aluminum sidewall of a thickness of from 0.1 to 1.5 mm;

an igniter-destructor charge contained within said capsule;

a flange element coupled to one end of the capsule and having an axial bore; and a plastic jacket covering and surrounding the full length of the aluminum sidewall, said plastic jacket serving to improve the mechanical stability of said elongated capsule.

17. The igniter-destructor device according to claim 16, further comprising an ignition-expediting material positioned within said charge.

18. The igniter-destructor device according to claim 16, wherein said plastic jacket is a shrink hose.

19. The igniter-destructor device according to claim 18, wherein said shrink hose has an inner adhesive coating.

20. The igniter-destructor device according to claim 19, wherein said shrink hose has a shrinking temperature of 100° to 200° C.

21. The igniter-destructor device according to claim 16, wherein said plastic jacket is a thermoplastic material.

22. The igniter-destructor device according to claim 21, wherein said plastic jacket is composed of a material selected from the group consisting of a polyolefin, polyethylene, polypropylene, polyisobutylene, polybutene, polyethyleneterephthalate, polyvinylchloride, a copolymer of any one of polyolefin, polyethylene, polypropylene, polyisobutylene, and polybutene.

23. The igniter-destructor device according to claim 21, wherein said plastic jacket has a tensile strength of 700 to 1,300 N/Cm$^2$.

24. The igniter-destructor device according to claim 23, wherein said plastic jacket has a wall thickness of 0.2 to 1.5 mm.

25. The igniter-destructor device according to claim 23, wherein said plastic jacket has a wall thickness of 0.3 to 0.8 mm.

26. The igniter-destructor device according to claim 23, wherein said aluminum sidewall has a thickness of 0.2 to 0.8 mm.

27. The igniter-destructor device according to claim 16, wherein said igniter-destructor charge is a powder charge formed of magnesium nitrate and barium nitrate.

28. The igniter-destructor device according to claim 16, wherein said ignition-expediting material is an agent formed of nitrocellulose powder.

29. The igniter-destructor device according to claim 28, wherein said ignition-expediting material has ignition particles statistically distributed within said igniter-destructor charge.

30. The igniter-destructor device according to claim 28, wherein said ignition-expediting material forms an ignition core axially penetrating said igniter-destructor charge.

31. The igniter-destructor device according to claim 30, wherein said ignition-expediting material has a 2 to 7 wt. % relative to a weight percentage of said igniter-destructor charge.

32. The igniter-destructor device according to claim 16, wherein said shrink hose has a shrinking temperature of 125° to 175° C.

* * * * *